US007896154B2

(12) United States Patent
Boatner

(10) Patent No.: US 7,896,154 B2
(45) Date of Patent: Mar. 1, 2011

(54) BIFURCATED BEVERAGE CAN WITH UNIFIED OPENING AND MIXING OPERATION

(76) Inventor: Barry Boatner, Daytona Beach, FL (US)

( * ) Notice: Subject to any disclaimer, the term of this patent is extended or adjusted under 35 U.S.C. 154(b) by 112 days.

(21) Appl. No.: 12/387,186

(22) Filed: Apr. 29, 2009

(65) Prior Publication Data

US 2010/0224512 A1 Sep. 9, 2010

Related U.S. Application Data

(63) Continuation-in-part of application No. 12/381,121, filed on Mar. 6, 2009.

(51) Int. Cl.
*B65D 25/08* (2006.01)

(52) U.S. Cl. ..... 206/221; 220/522

(58) Field of Classification Search ..... 206/219–222, 206/568; 215/DIG. 8; 220/258.4, 270, 277, 220/521, 522; 222/80, 192; 426/115, 120
See application file for complete search history.

(56) References Cited

U.S. PATENT DOCUMENTS 3,305,368 A * 2/1967 Bourelle ..... 206/219
4,264,007 A * 4/1981 Hunt ..... 206/219
4,333,581 A * 6/1982 Flansburg ..... 426/120
4,524,078 A * 6/1985 Bardsley et al. ..... 206/219
5,290,574 A * 3/1994 Jamieson et al. ..... 206/222
5,711,420 A * 1/1998 Spring ..... 206/219
5,819,923 A * 10/1998 Spring et al. ..... 206/222
5,885,635 A * 3/1999 Spring et al. ..... 426/120
7,163,129 B1 * 1/2007 Bennett ..... 206/222
7,681,726 B2 * 3/2010 O'Donnell et al. ..... 206/222

* cited by examiner

*Primary Examiner*—Luan K Bui
(74) *Attorney, Agent, or Firm*—J. Wiley Horton

(57) ABSTRACT

A beverage can having a primary fluid volume and a segregated secondary tipping container. The secondary tipping container is sealed prior to opening the beverage can so that its contents do not mix with the contents of the primary container. The beverage can has a lid with a conventional pull-tab and downward-opening hatch. The secondary tipping container is preferably attached to the underside of the lid. The tipping container has an open mouth which is preferably sealed against the underside. When the pull-tab is actuated, the hatch descends and detaches a portion of the tipping container from the lid so that the tipping container then pivots downward and spills its contents into the primary container.

20 Claims, 13 Drawing Sheets

BIFURCATED BEVERAGE CAN WITH UNIFIED OPENING AND MIXING OPERATION

CROSS-REFERENCES TO RELATED APPLICATIONS

This application is a continuation in part of U.S. application Ser. No. 12/381,121, which was filed on Mar. 6, 2009, pending. This application and the parent application list the same inventor.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of beverage containers. More specifically, the invention comprises a beverage can having a segregated primary volume and secondary volume where the "pull tab" that opens the can also mixes the contents of the secondary volume into the primary volume.

2. Description of the Related Art

Metal beverage cans have been in common use for many years. These were originally steel cans which had to be opened with a can opener. The "pull-tab" evolved in the 1950's. This allowed the can to be opened without using any external devices. The pull-tabs themselves, however, became a significant litter source.

In 1975 Reynolds Metals of Richmond, Va. introduced a pull-tab which remained attached to the beverage can after opening. The basic concept for this device has continued to evolve. FIG. 1 shows a prior art can assembly that has been manufactured since the 1990's. Can 10 is attached to lid 12, usually by roll forming the edges of the two components together to create roll seam 14. The bottom of the can is customarily integral with the cylindrical side wall—the can being made by a drawing process. The separate lid allows the can to be filled with a beverage—such as carbonated soda—before being sealed.

Prior art lid 12 has some sophisticated features allowing the can to be safely opened without producing litter. Lever 16 is attached to the lid at fulcrum 18. Contact arm 20 extends over hatch 24. The hatch is connected to the balance of the lid along tearable seam 22 (a line of reduced material thickness). The tearable seam extends around the periphery of the hatch, with the exception of a small undisturbed region that is intended to become a hinge when the hatch is opened.

FIG. 2 shows the same assembly when the user lifts lever 6 upward as shown. Contact arm 20 urges hatch 24 downward, which tears tearable seam 22. Bendable hinge 28 is the part of the hatch's periphery that does not include the tearable seam. The hatch bends downward from the lid along bendable hinge 28, as shown in the view.

FIG. 3 shows a plan view of the can with lever 16 removed so that the user may better understand the hatch and the tearable seam. Lever 16 attaches to the lid at attachment point 30 (which becomes the fulcrum in operation). The reader will note how tearable seam 22 extends around most of the periphery of hatch 24—except for the length of bendable hinge 28.

The bendable hinge is simply a region of undisturbed material which will not tear when the lever is actuated.

The reader will also note how the hinge is angled with respect to the orientation of lever 16. The hatch will pivot downward and to the left in the orientation shown in the view. Other designs have the tearable hinge immediately in front of the attachment point so that the hatch rotates in the same plane as lever 16. The present invention can be used with any of these designs, though the geometry may need to be altered somewhat.

There is a long-felt need in the art to provide the capacity to mix two substances together just before they are consumed. One application is the popular concept of a "mixed drink," in which liquor is often combined with a carbonated soft drink. Many of these combinations do not have a good shelf life when pre-mixed. In other words, they are best if the two components are mixed just prior to consumption.

Another example is the situation of a powdered additive being mixed into a liquid. Vitamins and other supplements are often presented in this fashion. Again, the mixture has a poor shelf life and it is therefore advisable to create the mixture just prior to consumption. The present invention provides two separated storage chambers which can be mixed just prior to consumption.

BRIEF SUMMARY OF THE INVENTION

The present invention comprises a beverage can having a primary fluid volume and a segregated secondary container. A first embodiment contains a piercer which pierces the secondary container when the beverage can is opened. The embodiment claimed in this patent contains a secondary tipping container which houses a liquid or a granulated solid. The secondary tipping container is sealed prior to opening the beverage can so that its contents do not mix with the contents of the primary container.

The beverage can has a lid with a conventional pull-tab and downward-opening hatch. The secondary tipping container is preferably attached to the underside of the lid. The tipping container has an open mouth which is preferably sealed against the underside. When the pull-tab is actuated, the hatch descends and detaches a portion of the tipping container from the lid so that the tipping container then pivots downward and spills its contents into the primary container.

REFERENCE NUMERALS IN THE DRAWINGS

| | | | |
|---|---|---|---|
| 10 | can | 12 | lid |
| 14 | roll seam | 16 | lever |
| 18 | fulcrum | 20 | contact arm |
| 22 | tearable seam | 24 | hatch |
| 26 | opening | 28 | bendable hinge |
| 30 | attachment point | 32 | primary fluid volume |
| 34 | secondary container | 36 | seal |
| 38 | piercer | 40 | secondary fluid |
| 42 | point | 44 | cutting edge |
| 46 | breach | 48 | roll crimping lip |
| 50 | side wall | 52 | bottom wall |
| 54 | stiff boundary | 60 | attachment |
| 62 | separate piercer | 64 | folded cross section |
| 66 | tipping container | 68 | opening |
| 70 | sealing flange | 72 | hinge flange |
| 74 | hatch tab | | |

DETAILED DESCRIPTION OF THE INVENTION

Figure 1:
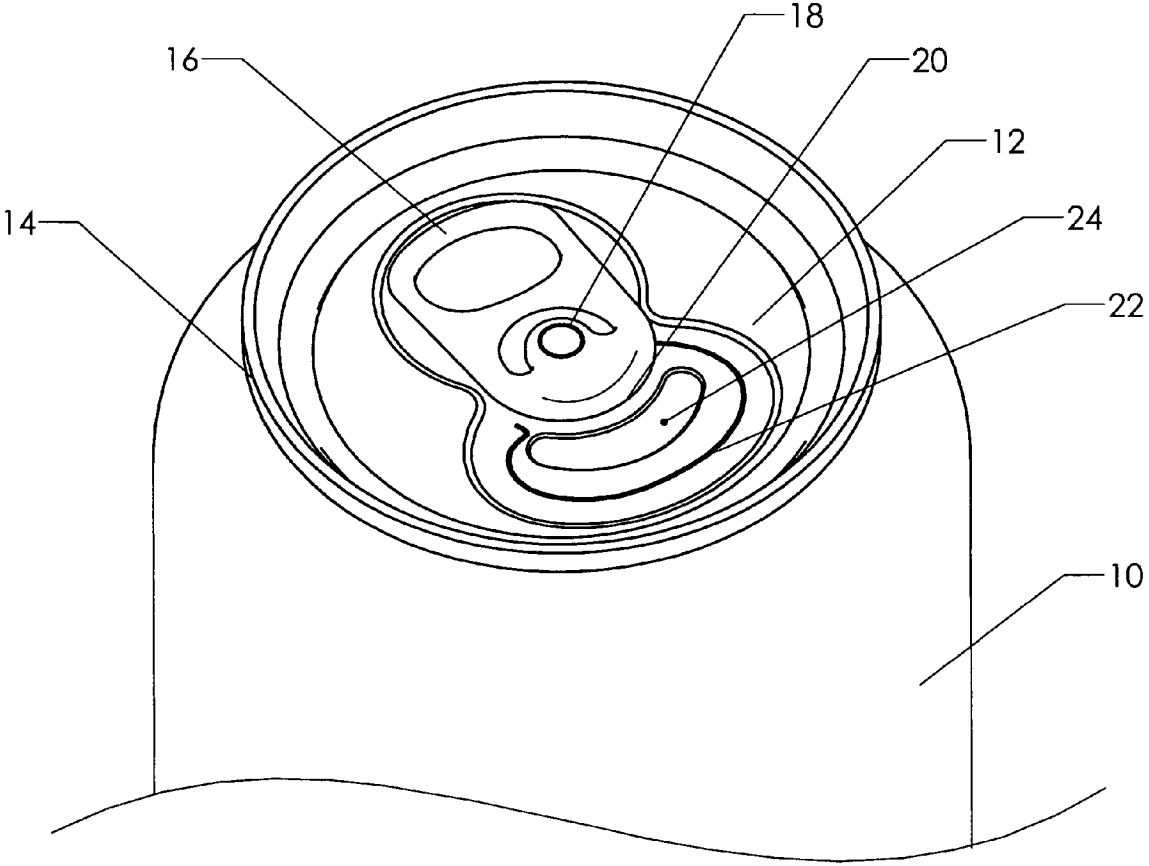
FIG. 1 (PRIOR ART)
FIG. 1 is a perspective view, showing a prior art beverage can.
Figure 2:
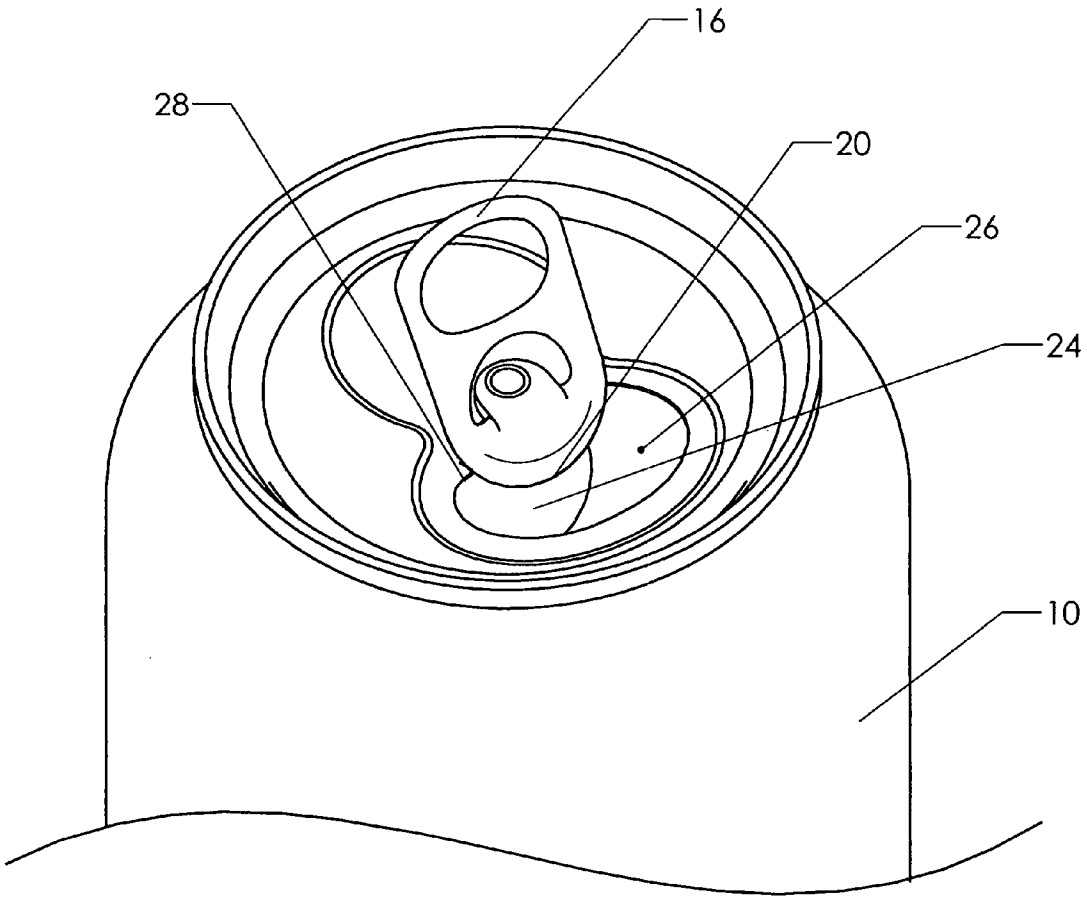
FIG. 2 (PRIOR ART)
FIG. 2 is a perspective view, showing a prior art beverage can with the pull-tab actuated to open the hatch.
Figure 3:
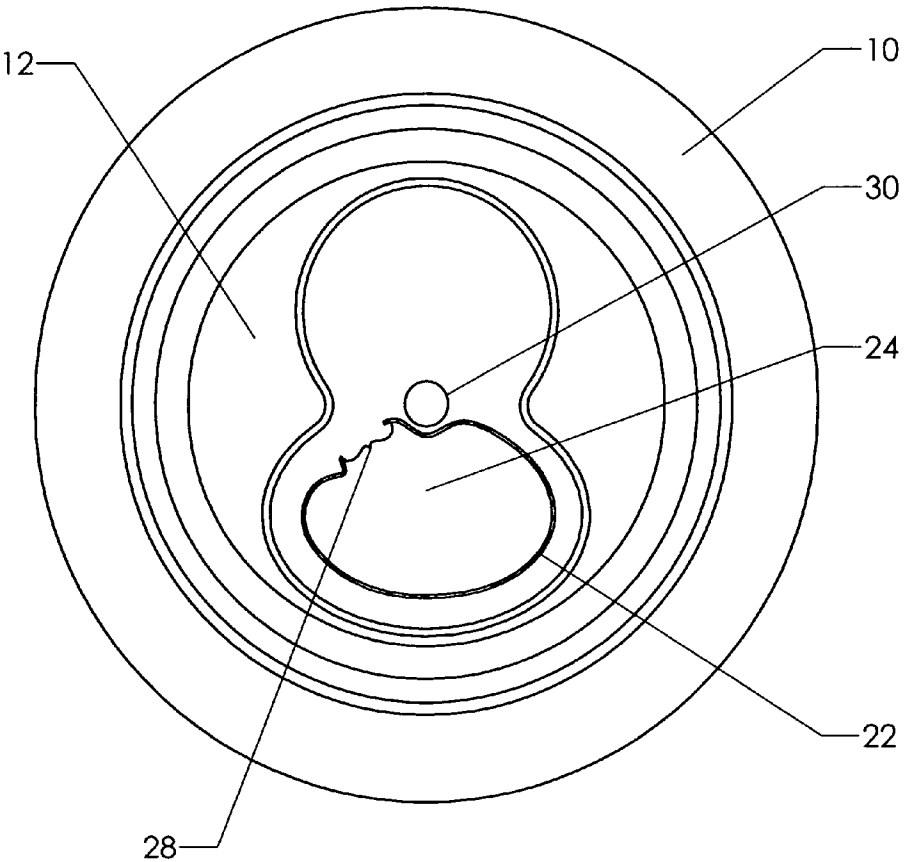
FIG. 3 (PRIOR ART)
FIG. 3 is a plan view, showing the nature of the hatch and tearable seam.
Figure 4:
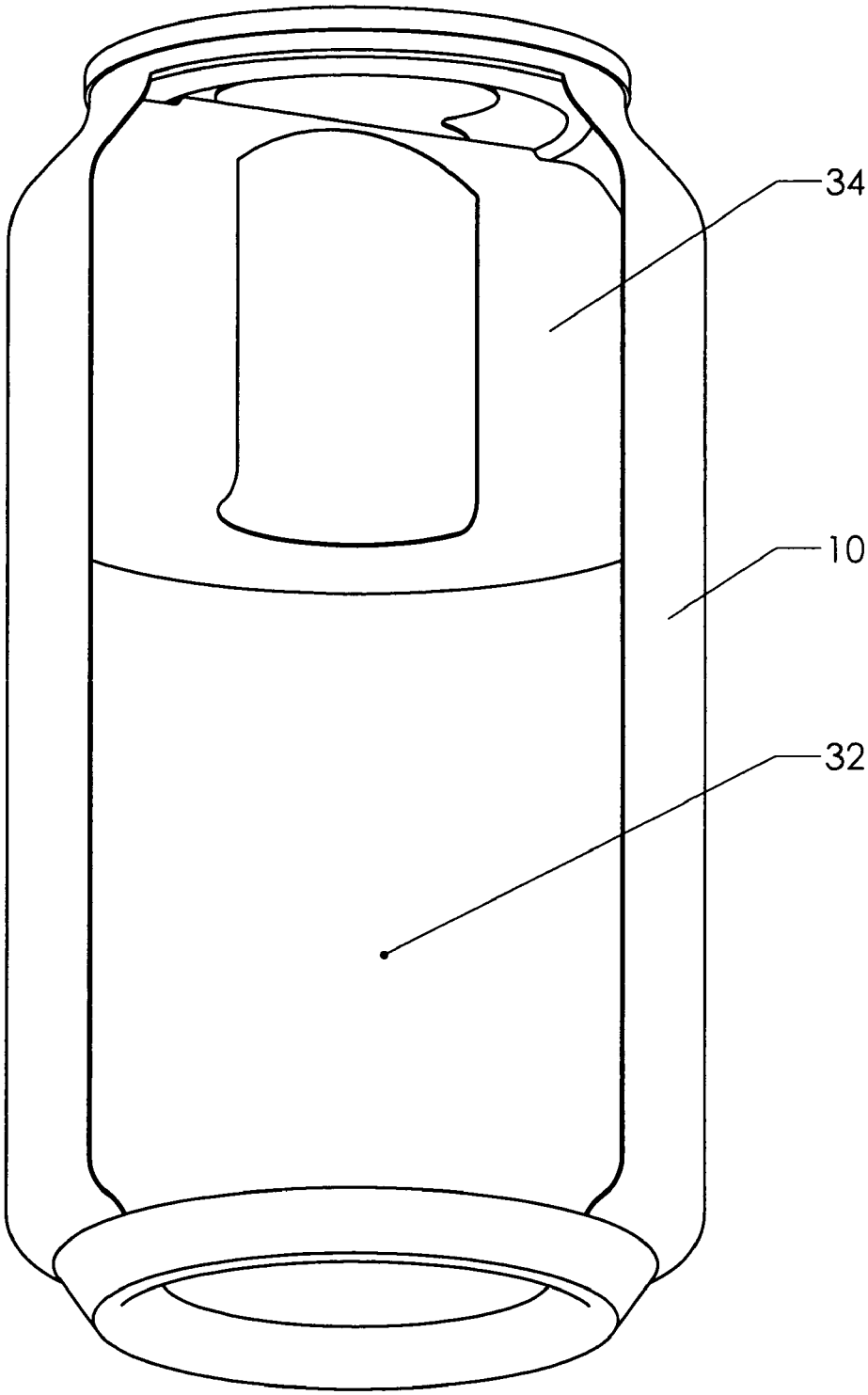
FIG. 4 is a perspective view with a cutaway, showing the secondary container.

FIG. 4 shows a first general embodiment of the invention in a cutaway view. Can 10 has a hollow interior designated as primary fluid volume 32. Secondary container 34 is located within the can's hollow interior. The secondary container is also hollow. Primary fluid volume 32 contains the primary fluid, such as a carbonated soft drink. The secondary container can contain many types of substances. The most common application is another liquid—such as liquor. However, the secondary container could also contain a granulated solid or even a gelatinous substance. The secondary container completely encloses its contents and prevents them from mixing with the primary fluid until the user desires to mix the two.

Figure 5:
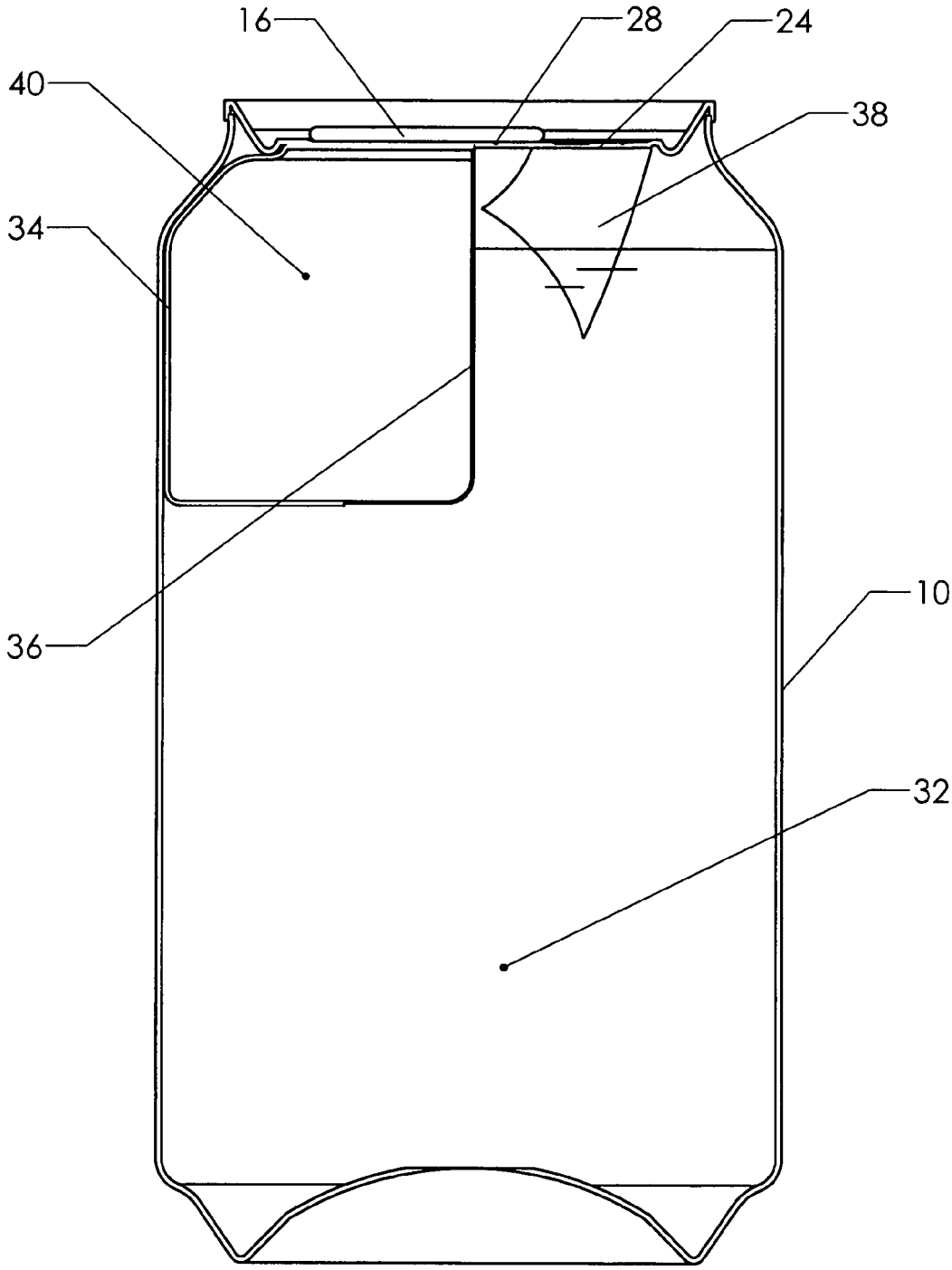
FIG. 5 is a sectional elevation view, showing the relationship of the internal components.

FIG. 5 shows a sectioned elevation view through the center of a can incorporating the present invention. The can's lid includes the same elements as in the prior art: Hatch 24 is attached to the lid along bendable hinge 28 (and a tearable seam, prior to actuation of the opening cycle). Lever 16 provides the actuating force to detach hatch 24 along the tearable seam and bend it down into the can's interior along bendable hinge 28.

Piercer 38 is connected to hatch 24 and rotates in unison with the hatch. Piercer 38 is positioned so that as the hatch rotates downwards, the piercer is propelled into secondary container 34. Piercer 38 is sufficiently sharp and stiff to breach the secondary container. As an example, the pierce can be a blade of thin aluminum.

Figure 6:
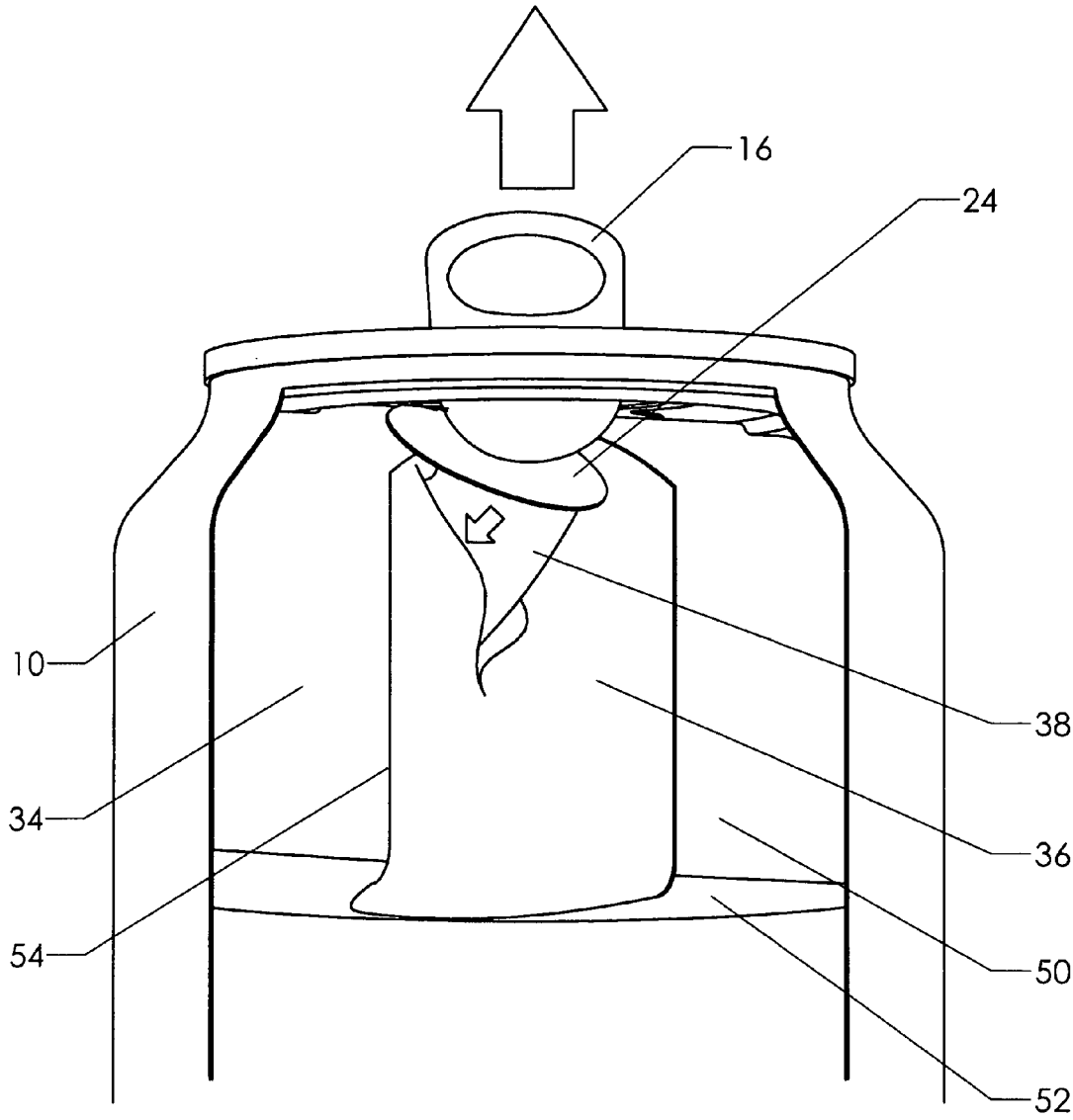
FIG. 6 is a perspective view with a cutaway, showing the piercer opening the seal.

The piercer can be configured to simply breach the side wall of the secondary container itself. However, it is preferable to provide a thin section of the side wall which is intended to be easily breached. In FIG. 5, a portion of the side wall is replaced by seal 36. This seal is preferably a thin foil—typically laminated with a thin layer of plastic—which is retained in placed by an adhesive. FIG. 6 shows a perspective view of the piercing mechanism (with a portion of the can cut away to aid visualization).

The side wall of the secondary container preferably includes stiff boundary 54, which runs around the opening covered by seal 36. This stiff boundary holds the seal in place and promotes rapid and complete tearing of the seal as piercer 38 penetrates. For some applications it is helpful to carry seal 36 around the corner between side wall 50 and bottom wall 52. This creates a corner in the seal which promotes tearing and also aids the rapid egress of the secondary container's contents.

Figure 7:
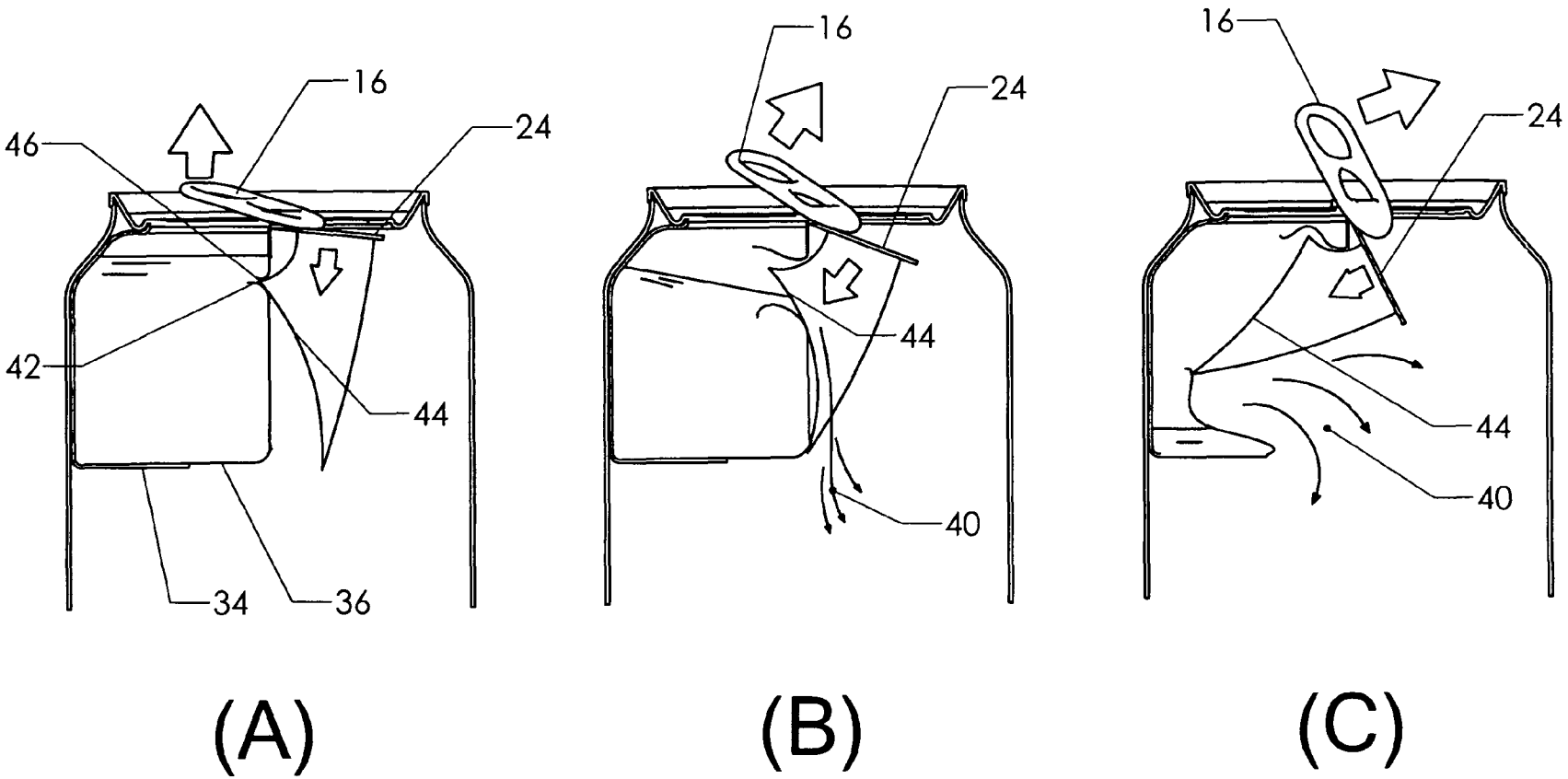
FIG. 7 is a sectional elevation view, showing the operation of the piercer.

The user lifts lever 16 as for the prior art can. This rotates hatch 24 down into the can's interior. Piercer 38 is propelled along with the hatch and ruptures seal 36. FIGS. 7(A) through 7(C) illustrate the piercing sequence in more detail. In FIG. 7(A), the user has just started lifting lever 16. Hatch 24 has just broken free along the tearable seam and has just started to rotate down into the can. In this embodiment, the piercer is equipped with point 42. Point 42 makes a sharp point contact with seal 36 and pokes an initial hole through it. This vents the top of the secondary container to promote rapid egress of its contents.

In FIG. 7(B), the user has continued lifting up on lever 16 and hatch 24 has rotated down about 30 degrees. Cutting edge 44 is at this point slicing through seal 36 and expanding the hole made by point 42. For the embodiment shown, the secondary substance is a fluid (secondary fluid 40). This secondary fluid begins to flow out of secondary container 34 and mix with the primary fluid.

In FIG. 7(C), the user has nearly completed the opening process. Hatch 24 has rotated down into the hollow interior about 85 degrees. Cutting edge 44 has completely breached seal 36 and secondary fluid 40 is then able to freely flow out into the can's hollow interior. The user is ideally encouraged to swirl the can at this point in order to promote thorough mixing of the primary fluid and the secondary substance.

Depending on the nature of the contents of the secondary container, it may be desirable to extend the length of seal 36 over a greater distance of the container's bottom. The length of cutting edge 44 can likewise be extended to carry all the way across the bottom of the secondary container as the device is actuated. In addition, the cutting edge can be provided with flanges to make the edge into a "plow" configuration (with one flange extending out one side and possible a second flange extending out the other). In this embodiment, the sharp edge pierces the seal and the flanges then spread the seal apart as the blade proceeds into the secondary container.

Figure 8:
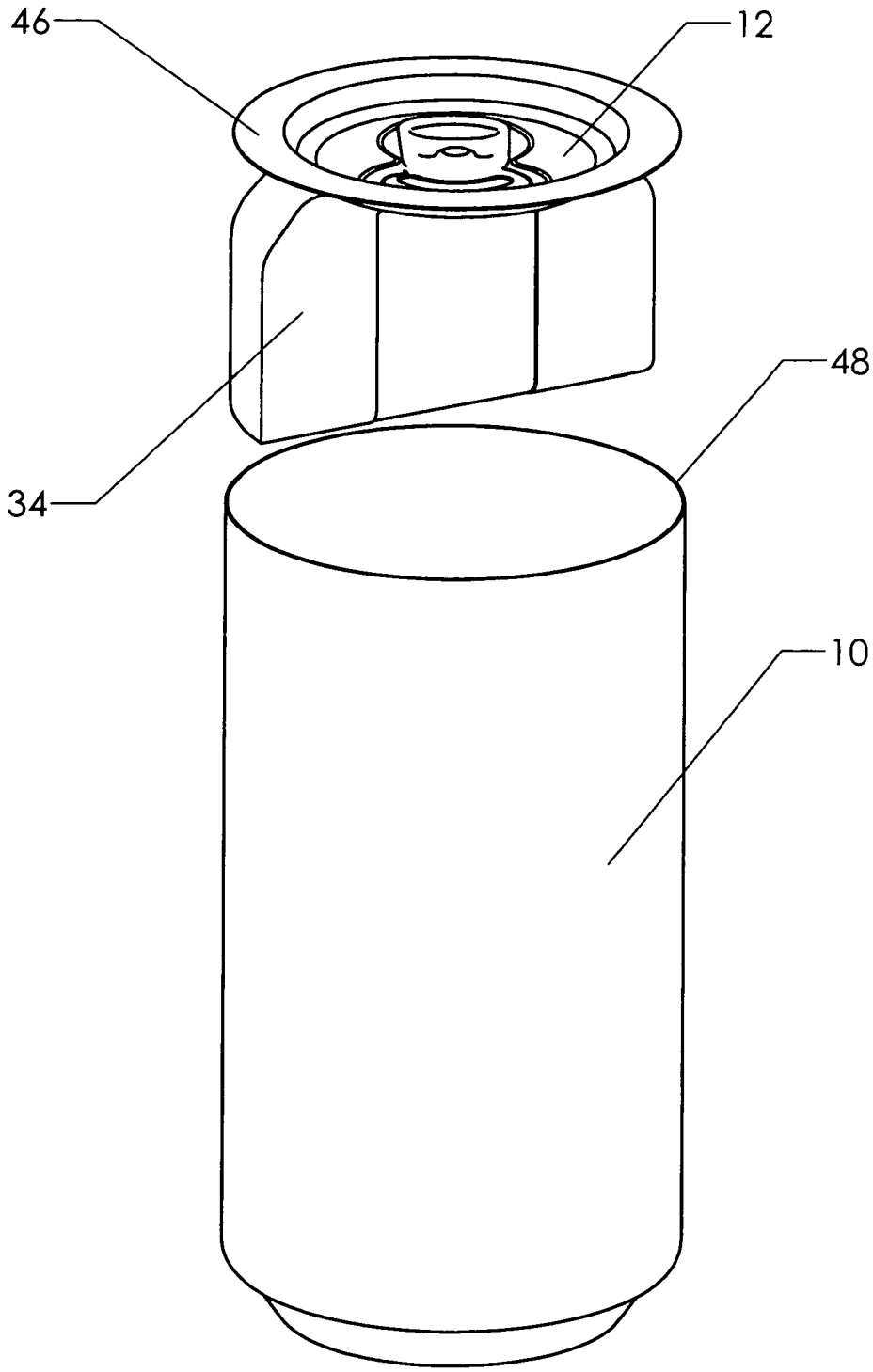
FIG. 8 is an exploded perspective view, showing how the lid and secondary container can be united into a subassembly.

The arrangement proposed by the present invention is preferably made to be incorporated into the existing manufacturing processes. As mentioned previously, modern soft drink cans are made as two pieces—the can and the lid. These are then roll crimped together. FIG. 8 shows a prior art can 10. The can is filled with the primary liquid. The innovative features of the present invention can then be incorporated into lid 12. The piercer is preferably attached to the lid. Though it certainly could be attached to the can wall as well, attaching the piercer somewhere on the lid promotes easy assembly.

Secondary container 34 is preferably attached to the underside of the lid to make a unified subassembly. Roll crimping flange extends around the lid's perimeter. The subassembly shown is then placed on top of the can (after the can is filled), and the roll crimping flange is rolled together with roll crimping lip 48 to create a finished product. The product is then ready for delivery. The primary fluid and the secondary substance will remain separated until the user pulls up the lever on the can's lid. Using this approach, the can and the secondary container/lid subassembly can be made on different lines which are brought together just before the roll crimping process.

Figure 9:
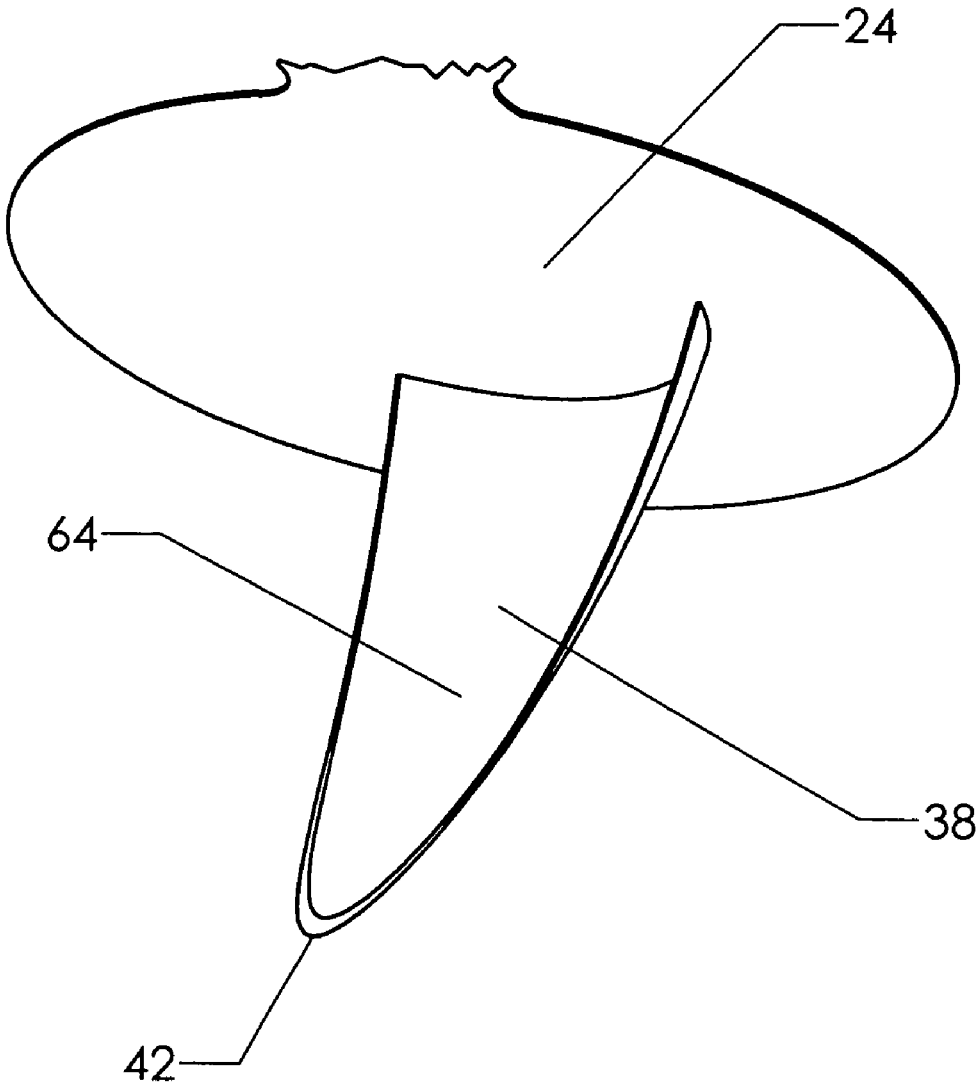
FIG. 9 is a perspective view, showing an alternate embodiment for the piercer.

Those skilled in the art will readily appreciate that many variations on the design of the secondary container and the piercer are possible. FIG. 9 shows one such alternate embodiment. Piercer 38 is formed into a sharpened "scoop" by giving it folded cross-section 64. This stiffens the piercer. Point 42 is still provided.

Figure 10:
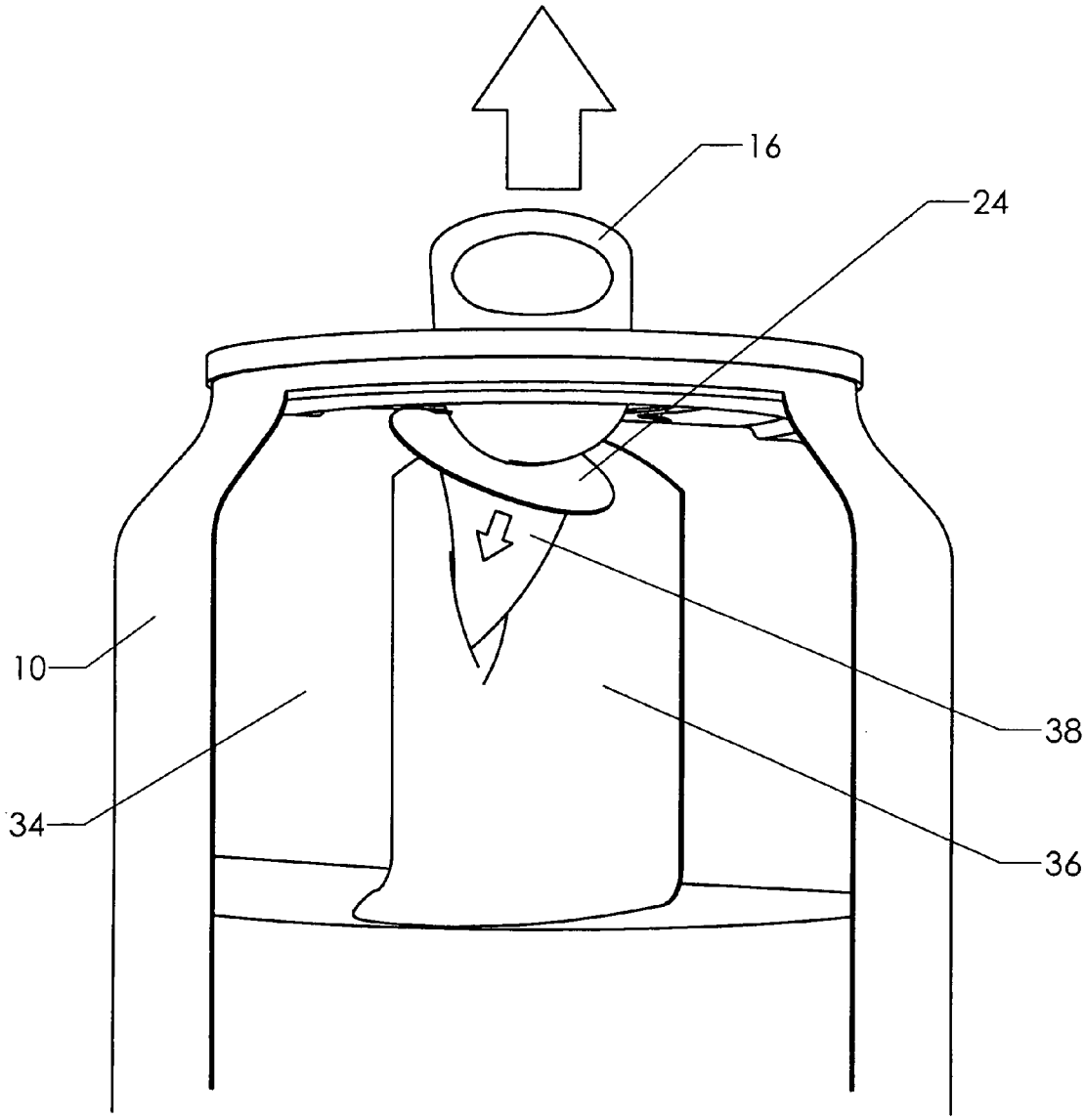
FIG. 10 is a perspective view with a cutaway, showing the operation of the embodiment of FIG. 9.

FIG. 10 shows this alternate embodiment in operation. Lever 16 and hatch 24 operate in the same manner as previously described. Piercer 38 pokes through seal 36 and expands the breach as the hatch pivots further downward.

Figure 11:
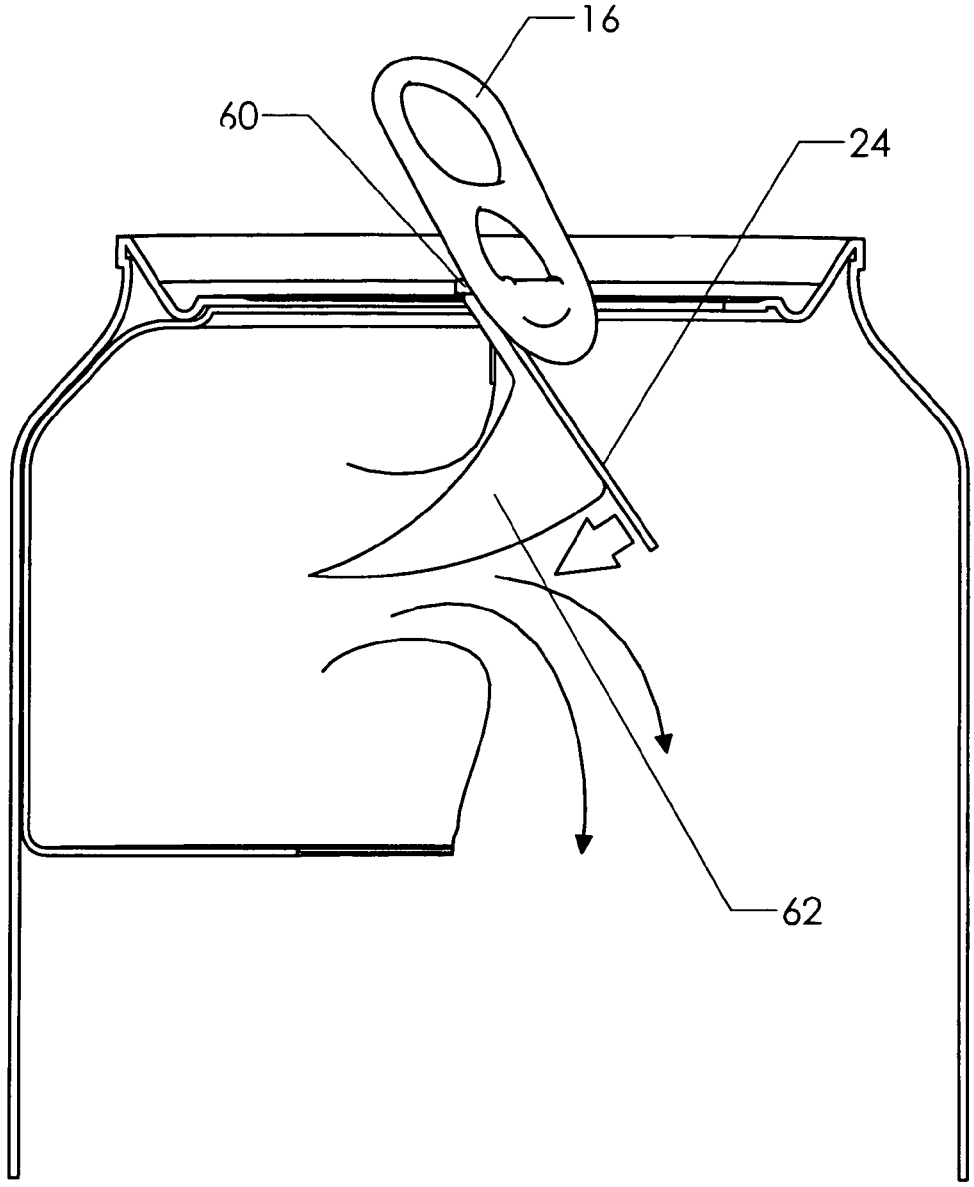
FIG. 11 is a sectional elevation view, showing another alternate embodiment for the piercer.

In many respects it is preferable to attach the piercer directly to the bottom of the hatch. However, there are other ways to secure the piercer. FIG. 11 shoes an alternate embodiment in which separate piercer 62 is attached at attachment 60 to the underside of the lid itself. The attachment is preferably a bendable piece of thin aluminum. The hatch still propels this piercer into the secondary container and it performs in the same manner as the previously disclosed embodiments. Attachment 60 could even be the same rivet that joins lever 16 to the top of the lid.

Of course, one could also secure the piercer to the secondary container. The pivoting attachment for the piercer would be roughly the same as shown in FIG. 11, except that the piercer would be attached to the upper part of the secondary container itself rather than the lid. The piercer could also be attached to the side wall of the can itself. As long as the piercer is positioned so that the hatch's motion propels it into the secondary container, any of these attachments will work.

Figure 12:
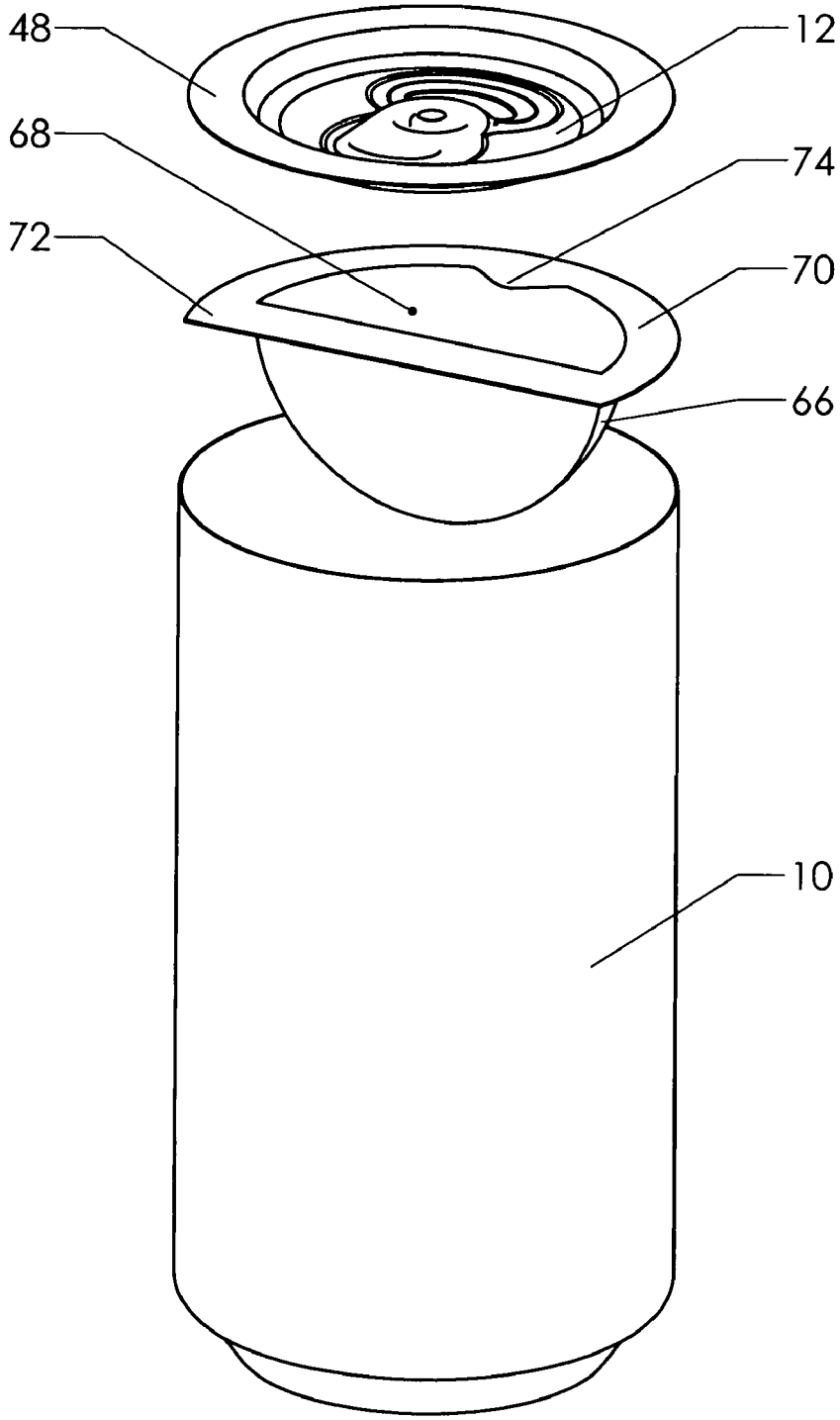
FIG. 12 is an exploded perspective view, showing an embodiment using a tipping secondary fluid container instead of a fixed and breachable secondary fluid container.
Figure 13:
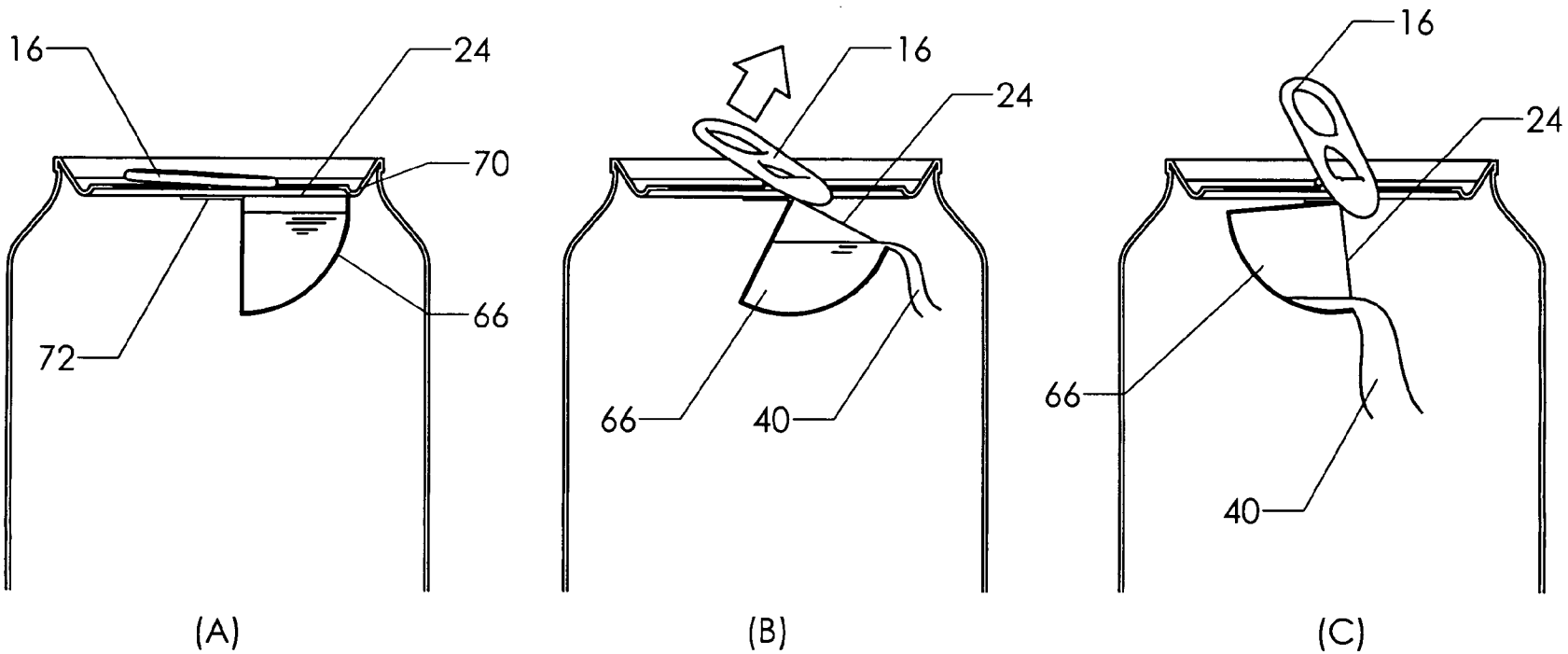
FIG. 13 is a sectional elevation view, showing the operation of the tipping container.

One can also make a configuration which does not require the piercing action. FIGS. 12 and 13 show still another alternate embodiment which takes a different approach. This alternate embodiment is the subject of the claims in this application. FIG. 12 is an exploded perspective view showing can 10 and lid 12 as for the prior embodiments. However, the secondary container assumes a significantly different form. The secondary container assumes the form of tipping container 66. The tipping container contains an opening 68. This opening is preferably surrounded by sealing flange 70—an extended "lip" which makes a broader contact area in order to seal the opening.

The tipping container can be secured to any convenient surface inside the can. In the embodiment shown, it is secured to the underside of lid 12, with opening 68 facing upward as shown. Sealing flange 70 is preferably affixed to the underside of the lid using an adhesive. Hinge flange 72 is also affixed using an adhesive. However, the adhesive used to attach the sealing flange must be weaker so that the sealing flange may pull away when the can is opened.

FIG. 13 is a sectional elevation view showing the opening sequence of the can with the tipping container in place. In FIG. 13(A) the tipping container is attached to the underside of the lid with opening 68 being sealed against the lid. Hinge flange 72 is also attached to the lid. This is referred to as the "first position" for the tipping container, which means a position in which the tipping container's contents are segregated from the contents of the rest of the can.

In FIG. 13(B) the user has pulled upward on lever 16 and hatch 24 has been forced down into the can. Sealing flange 70 has pulled away from the lid and opening 68 is now tilted downward. The contents of the tipping container (in this case secondary fluid 40) therefore begin to spill out and flow into the can's interior. In FIG. 13(C) the hatch is swung fully downward. Tipping container 66 has pivoted down to a position where substantially all of its contents are able to flow out through opening 68. This position is referred to as the "second position," which means the position in which the tipping container's contents are free to mingle with the contents of the rest of the can.

Returning now to FIG. 12, some additional features will be described. Hinge flange 72 is preferably made from a thin and flexible material such as a polymer. The hinge flange is secured to the lid (or other part of the can) using a relatively strong adhesive so that it will remain attached when the balance of the tipping container pivots away from the first position. The hinge flange will bend in order to accommodate this motion. It may be necessary to scribe or mold a thinned line across the hinge flange so that it bends in the desired location. As one example, the highe flange, sealing flange, and the balance of the tipping container could all be formed as one integral piece of plastic.

The sealing flange is preferably attached to the underside of the lid using a relatively weak adhesive. Using this approach the sealing flange will break free and pivot downward while the hinge flange remains attached—providing a stable pivot point for the desired motion.

An alternative is to place a compressible seal around the perimeter of the opening which seals the tipping container by being pressed against the underside of the lid. Hatch tab 74 can then be provided as an anchoring point where the pivoting part of the container is attached directly to the underside of the hatch. Those skilled in the art will recognize many other ways to seal the open part of the tipping container and the invention is by no means limited to the examples given.

The reader will thereby perceive how the present invention provides a storage can having a separate secondary container which unites two substances as the user pulls up on the opening lever. The device can be used to mix: (1) Liquor and a soft drink to make a "mixed drink" such as Rum and Coke; (2) a granulated solid and water to make a sports drink; (3) a heavy syrup and a low viscosity liquid; or (4) any other suitable combination of ingredients.

The preceding description contains significant detail regarding the novel aspects of the present invention. It is should not be construed, however, as limiting the scope of the invention but rather as providing illustrations of the preferred embodiments of the invention. Thus, the scope of the invention should be fixed by the following claims, rather than by the examples given.

Having described my invention, I claim:

1. A container for providing a mixture of a primary fluid and a secondary substance to a consumer, comprising:

a. a can having a hollow interior, said hollow interior containing a primary fluid;

b. a lid on said can;

c. a secondary container having a hollow interior within said hollow interior of said can, said secondary container being pivotally attached to said lid so that said secondary container is movable between a first position and a second position;

d. a secondary substance located within said secondary container;

e. a hatch in said lid, said hatch being connected to said lid by a hinge;

f. a hatch-actuating lever on said lid, positioned so that lifting said lever forces said hatch to swing downward into said hollow interior of said can;

g. said secondary container being positioned so that said downward motion of said hatch into said hollow interior of said can moves said secondary container from said first position to said second position; and h. said secondary container including an opening which is sealed against said lid when said secondary container is in said first position but which is unsealed when said secondary container is in said second position.

2. A container for providing a mixture of a primary fluid and a secondary substance to a consumer as recited in claim 1, wherein said opening in said secondary container is sealed against the underside of said lid when said secondary container is in said first position.

3. A container for providing a mixture of a primary fluid and a secondary substance to a consumer as recited in claim 2, wherein said opening in said secondary container is surrounded by a sealing flange.

4. A container for providing a mixture of a primary fluid and a secondary substance to a consumer as recited in claim 3, wherein said sealing flange is bonded to the underside of said lid by an adhesive.

5. A container for providing a mixture of a primary fluid and a secondary substance to a consumer as recited in claim 2, further comprising:

a. a hinge flange adjacent to said opening;

b. said hinge flange having a stationary portion and a pivoting portion; and c. said stationary portion of said hinge flange being attached to said underside of said lid.

6. A container for providing a mixture of a primary fluid and a secondary substance to a consumer as recited in claim 3, further comprising:

a. a hinge flange adjacent to said opening;

b. said hinge flange having a stationary portion and a pivoting portion;

c. said stationary portion of said hinge flange being attached to said underside of said lid; and d. said pivoting portion of said hinge flange being connected to said sealing flange.

7. A container for providing a mixture of a primary fluid and a secondary substance to a consumer as recited in claim 2, further comprising a hatch tab attached to said secondary container positioned to bear against said hatch when said hatch swings downward.

8. A container for providing a mixture of a primary fluid and a secondary substance to a consumer as recited in claim 3, further comprising a hatch tab attached to said secondary container positioned to bear against said hatch when said hatch swings downward.

9. A container for providing a mixture of a primary fluid and a secondary substance to a consumer as recited in claim 6, further comprising a hatch tab attached to said secondary container positioned to bear against said hatch when said hatch swings downward.

10. A container for providing a mixture of a primary fluid and a secondary substance to a consumer as recited in claim 3, further comprising a compressible seal located on said sealing flange.

11. A container for providing a mixture of a primary fluid and a secondary substance to a consumer, comprising:

a. a can having a hollow interior, said hollow interior containing a primary fluid;

b. a lid on said can;

c. a secondary container having a hollow interior within said hollow interior of said can, said secondary container being pivotally attached to the underside of said lid so that said secondary container is movable between a first position and a second position;

d. a secondary substance located within said secondary container;

e. a hatch in said lid, said hatch being connected to said lid by a hinge;

f. a hatch-actuating lever on said lid, positioned so that lifting said lever forces said hatch to swing downward into said hollow interior of said can;

g. said secondary container being positioned so that said downward motion of said hatch into said hollow interior of said can moves said secondary container from said first position to said second position; and h. said secondary container including an opening positioned so that said opening faces upward when said secondary container is in said first position.

12. A container for providing a mixture of a primary fluid and a secondary substance to a consumer as recited in claim 11, wherein said opening in said secondary container is sealed against the underside of said lid when said secondary container is in said first position.

13. A container for providing a mixture of a primary fluid and a secondary substance to a consumer as recited in claim 12, wherein said opening in said secondary container is surrounded by a sealing flange.

14. A container for providing a mixture of a primary fluid and a secondary substance to a consumer as recited in claim 13, wherein said sealing flange is bonded to the underside of said lid by an adhesive.

15. A container for providing a mixture of a primary fluid and a secondary substance to a consumer as recited in claim 12, further comprising:

a. a hinge flange adjacent to said opening;

b. said hinge flange having a stationary portion and a pivoting portion; and c. said stationary portion of said hinge flange being attached to said underside of said lid.

16. A container for providing a mixture of a primary fluid and a secondary substance to a consumer as recited in claim 13, further comprising:

a. a hinge flange adjacent to said opening;

b. said hinge flange having a stationary portion and a pivoting portion;

c. said stationary portion of said hinge flange being attached to said underside of said lid; and d. said pivoting portion of said hinge flange being connected to said sealing flange.

17. A container for providing a mixture of a primary fluid and a secondary substance to a consumer as recited in claim 12, further comprising a hatch tab positioned to bear against said hatch when said hatch swings downward.

18. A container for providing a mixture of a primary fluid and a secondary substance to a consumer as recited in claim 13, further comprising a hatch tab positioned to bear against said hatch when said hatch swings downward.

19. A container for providing a mixture of a primary fluid and a secondary substance to a consumer as recited in claim 16, further comprising a hatch tab positioned to bear against said hatch when said hatch swings downward.

20. A container for providing a mixture of a primary fluid and a secondary substance to a consumer as recited in claim 13, further comprising a compressible seal located on said sealing flange.

* * * * *